US010598413B2

(12) United States Patent
Ote

(10) Patent No.: US 10,598,413 B2
(45) Date of Patent: Mar. 24, 2020

(54) AIR-CONDITIONING APPARATUS

(71) Applicant: Mitsubishi Electric Corporation, Tokyo (JP)

(72) Inventor: Toshinori Ote, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 102 days.

(21) Appl. No.: 15/559,628

(22) PCT Filed: Jul. 8, 2015

(86) PCT No.: PCT/JP2015/069604
§ 371 (c)(1),
(2) Date: Sep. 19, 2017

(87) PCT Pub. No.: WO2017/006452
PCT Pub. Date: Jan. 12, 2017

(65) Prior Publication Data
US 2018/0073786 A1 Mar. 15, 2018

(51) Int. Cl.
*F25B 31/00* (2006.01)
*F25B 13/00* (2006.01)
*F25B 49/02* (2006.01)

(52) U.S. Cl.
CPC ..... *F25B 31/004* (2013.01); *F25B 13/00* (2013.01); *F25B 31/002* (2013.01); *F25B 49/02* (2013.01);
(Continued)

(58) Field of Classification Search
CPC ... F25B 31/004; F25B 49/022; F25B 2500/16
See application file for complete search history.

(56) References Cited

U.S. PATENT DOCUMENTS 4,492,209 A * 1/1985 Otani ..... F02B 61/02 123/568.27
5,369,958 A * 12/1994 Kasai ..... F24F 3/065 62/158
(Continued)

FOREIGN PATENT DOCUMENTS

EP 2500675 A1 9/2012
JP H06-129717 A 5/1994
(Continued)

OTHER PUBLICATIONS

International Search Report of the International Searching Authority dated Sep. 15, 2015 for the corresponding International Application No. PCT/JP2015/069604 (and English translation).
(Continued)

*Primary Examiner* — Nelson J Nieves
(74) *Attorney, Agent, or Firm* — Posz Law Group, PLC

(57) ABSTRACT

An air-conditioning apparatus includes: a refrigerant circuit including a compressor, an indoor heat exchanger, an expansion valve, and an outdoor heat exchanger that are connected by a refrigerant pipe so that refrigerant circulates through the refrigerant circuit; and a controller configured to control an operation state of the compressor, in which the controller is configured to estimate an oil concentration inside the compressor based on a temperature of gas refrigerant discharged from the compressor and a pressure of the gas refrigerant discharged from the compressor, and when the oil concentration is less than an oil concentration reference value, continue an operation of the compressor even under a state in which the thermo-off condition is satisfied.

5 Claims, 4 Drawing Sheets

(52) U.S. Cl.
CPC ..... *F25B 49/022* (2013.01); *F25B 2500/16* (2013.01); *F25B 2500/26* (2013.01); *F25B 2600/0261* (2013.01); *F25B 2600/2501* (2013.01); *F25B 2700/1931* (2013.01); *F25B 2700/21152* (2013.01)

(56) References Cited

U.S. PATENT DOCUMENTS 5,761,914 A * 6/1998 Carey ..... F25B 1/047 62/157
5,884,494 A * 3/1999 Okoren ..... F04C 28/28 62/126
6,138,465 A * 10/2000 Fogh ..... F25D 29/00 62/157
6,578,373 B1 * 6/2003 Barbier ..... F25B 49/005 236/78 D
9,939,184 B2 * 4/2018 Yura ..... F25B 31/002
2004/0159111 A1 * 8/2004 Takegami ..... F25B 13/00 62/84
2005/0103035 A1 * 5/2005 He ..... F25B 31/002 62/192
2008/0209924 A1 * 9/2008 Yoon ..... F25B 31/004 62/84
2009/0025410 A1 * 1/2009 Tanaka ..... F25B 41/043 62/228.1
2009/0107173 A1 * 4/2009 Yoon ..... F25B 31/004 62/510
2011/0155816 A1 * 6/2011 Jeong ..... F25B 31/004 236/92 B
2012/0011872 A1 * 1/2012 Dugast ..... F25B 43/02 62/238.6
2012/0023989 A1 * 2/2012 Kinoshita ..... F24F 11/70 62/186
2012/0073317 A1 * 3/2012 Lee ..... F25D 23/02 62/115
2012/0227430 A1 * 9/2012 Takeuchi ..... F25B 49/02 62/228.1
2015/0135750 A1 * 5/2015 Ushijima ..... F24H 4/02 62/159
2016/0003511 A1 * 1/2016 Esformes ..... F25B 31/004 62/84
2016/0018148 A1 * 1/2016 Yura ..... F25B 13/00 62/192
2016/0123325 A1 * 5/2016 Kim ..... F04C 28/28 418/55.1
2016/0252284 A1 * 9/2016 Kibo ..... F24F 11/30 62/115
2017/0197492 A1 * 7/2017 Ishizeki ..... B60H 1/32
2018/0023870 A1 * 1/2018 Ohura ..... F24F 11/89 62/195

FOREIGN PATENT DOCUMENTS

JP 2010-038503 A 2/2010
WO 2014136865 A1 9/2014

OTHER PUBLICATIONS

Extended European Search Report mailed by the European Patent Office dated Feb. 27, 2017 for the corresponding European Patent Application No. 15871308.1 (and English translation).
Office Action dated Dec. 5, 2017 issued in corresponding JP patent application No. 2017-527027 (and English translation).
Invitation pursuant to Article 94(3) and Rule 71(1) EPC dated Oct. 17, 2017 corresponding to EP patent application No. 15871308.1.

* cited by examiner

AIR-CONDITIONING APPARATUS

CROSS REFERENCE TO RELATED APPLICATION

This application is a U.S. national stage application of PCT/JP2015/069604 filed on Jul. 8, 2015, the contents of which are incorporated herein by reference.

TECHNICAL FIELD

The present invention relates to an air-conditioning apparatus configured to maintain an oil concentration of a compressor at a sufficient level under a state in which a thermo-off operation is performed.

BACKGROUND ART

To lubricate a drive portion such as a motor shaft, refrigerating machine oil is sealingly filled in a compressor of an air-conditioning apparatus. When refrigerant in a wet vapor state is sucked into the compressor at the time of starting the compressor, or when a stagnation state in which refrigerant dissolves in the refrigerating machine oil is reached while the compressor is not operating, the refrigerating machine oil is mixed with the refrigerant, and is diluted as a result. When the operation of the air-conditioning apparatus is continued for a long period of time under a state in which a concentration of the oil is at a low level, the motor shaft and the like are not sufficiently lubricated. Thus, there is a fear that wear or burning may occur, resulting in a failure. Under a normal state, when the air-conditioning apparatus operates for a while after being started, the compressor is heated, and the refrigerant mixed with the refrigerating machine oil evaporates to be discharged. Thus, an oil concentration required for the operation is maintained.

There is known a technology in which a concentration of refrigerating machine oil inside a compressor is detected and the operation of the compressor is controlled appropriately depending on the detected concentration (see, for example, Patent Literature 1).

CITATION LIST

Patent Literature

Patent Literature 1: Japanese Unexamined Patent Application Publication No. 2010-38503

SUMMARY OF INVENTION

Technical Problem

However, under a state in which the thermo-off operation is frequently performed, for example, when an ambient temperature on a room side that is being air-conditioned and a preset temperature of the air-conditioning apparatus are close to each other, the compressor repeats stopping and restarting before the oil concentration reaches a sufficient level. In this case, the compressor continues the repetitive operation while the oil concentration is at a low level. As a result, there is a fear that wear or burning may occur in the motor shaft of the compressor or the like, resulting in a failure of the compressor.

The present invention has been made to overcome the above-mentioned problem, and provides an air-conditioning apparatus configured to maintain an oil concentration of a compressor at a sufficient level under a state in which a condition under which the thermo-off operation takes place (thermo-off condition) is satisfied.

Solution to Problem

According to one embodiment of the present invention, there is provided an air-conditioning apparatus, including: a refrigerant circuit comprising a compressor, an indoor heat exchanger, an expansion valve, and an outdoor heat exchanger that are connected by a refrigerant pipe to allow refrigerant to circulate through the refrigerant circuit; and a controller configured to control an operation state of the compressor, the controller being configured to estimate an oil concentration inside the compressor based on a temperature of gas refrigerant discharged from the compressor and a pressure of the gas refrigerant discharged from the compressor, and when the oil concentration is less than an oil concentration reference value, continue an operation of the compressor even under a state in which a thermo-off condition is satisfied.

Advantageous Effects of Invention

In the air-conditioning apparatus according to the present invention, the controller is configured to continue the operation of the compressor even under the state in which the thermo-off condition is satisfied. With this, the compressor is heated, and thus the refrigerant mixed with the refrigerating machine oil evaporates and the degree of superheat of the discharged gas refrigerant reaches a sufficient level. Accordingly, under a state in which the thermo-off condition is satisfied frequently, the operation is not turned on and off repeatedly for a long period of time while the oil concentration is at a low level, where lubricity is low. Therefore, under the state in which the thermo-off condition is satisfied, the oil concentration of the compressor can be maintained at a sufficient level. As a result, the reliability of the compressor can be enhanced.

DESCRIPTION OF EMBODIMENTS

Now, embodiments of the present invention are described with reference to the drawings.

Note that, in the following drawings, components denoted by the same reference symbols correspond to the same or equivalent components. This is common throughout the description herein.

In addition, the forms of the components described herein are merely examples, and the components are not limited to the description herein.

Embodiment 1

Figure 1:
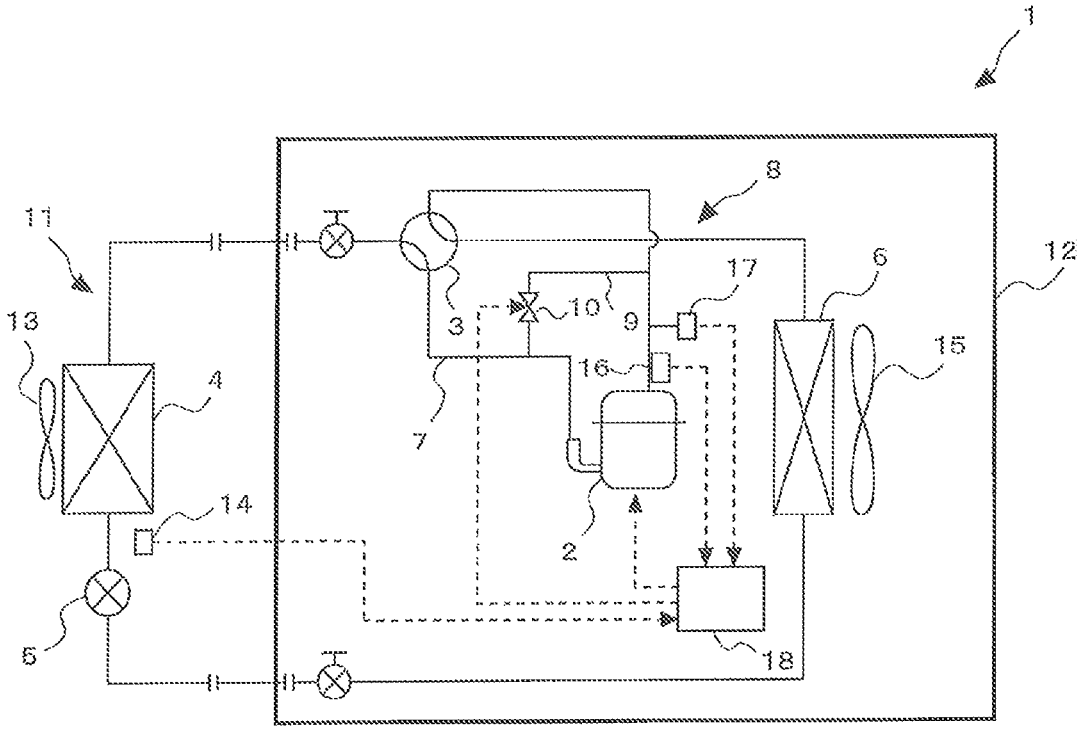
FIG. 1 is a diagram for illustrating an overall configuration of an air-conditioning apparatus according to Embodiment 1 of the present invention.

FIG. 1 is a diagram for illustrating an overall configuration of an air-conditioning apparatus 1 according to Embodiment 1 of the present invention.

The air-conditioning apparatus 1 includes a refrigerant circuit 8 including a compressor 2, a four-way valve 3, an indoor heat exchanger 4, an expansion valve 5, an outdoor heat exchanger 6, and an accumulator (not shown) that are connected by a refrigerant pipe 7 so that refrigerant circulates through the refrigerant circuit 8.

Further, the refrigerant circuit 8 includes a bypass pipe 9 connecting a portion of the refrigerant pipe 7 on a discharge side of the compressor 2 and a portion of the refrigerant pipe 7 on a suction side of the compressor 2, and a bypass valve 10 arranged in the middle of the bypass pipe 9.

The air-conditioning apparatus 1 includes an indoor unit 11 and an outdoor unit 12.

The indoor unit 11 of the air-conditioning apparatus 1 includes the indoor heat exchanger 4, a fan 13 configured to blow indoor air to the indoor heat exchanger 4, and the expansion valve 5.

The indoor heat exchanger 4 includes, for example, a plate heat exchanger.

The expansion valve 5 is configured to reduce a pressure of a high-pressure refrigerant to change the state of the refrigerant into a low-pressure two-phase refrigerant.

Further, the indoor unit 11 of the air-conditioning apparatus 1 includes an indoor temperature sensor 14 configured to detect an indoor temperature.

The outdoor unit 12 of the air-conditioning apparatus 1 includes the compressor 2, the four-way valve 3, the outdoor heat exchanger 6, and a fan 15 configured to blow outside air to the outdoor heat exchanger 6.

The compressor 2 includes, for example, a capacity-controllable inverter compressor and other elements. The compressor 2 is configured to suck and compress a low-temperature and low-pressure gas refrigerant to change the state of the refrigerant into a high-temperature and high-pressure gas refrigerant, and discharge the high-temperature and high-pressure gas refrigerant. In order to lubricate a drive portion such as a motor shaft, refrigerating machine oil is sealingly filled in the compressor 2. The refrigerant dissolves in the refrigerating machine oil.

The four-way valve 3 is configured to switch a flow passage of the refrigerant flowing through the refrigerant circuit 8 depending on whether the operation of the air-conditioning apparatus 1 is a cooling operation or a heating operation.

The outdoor heat exchanger 6 includes, for example, a plate-fin heat exchanger and others. The outdoor heat exchanger 6 is configured to exchange heat between the refrigerant and outside air to evaporate the refrigerant.

Further, the outdoor unit 12 of the air-conditioning apparatus 1 includes, on a surface of the compressor 2 or on a discharge pipe thereof, a temperature sensor 16 configured to detect a temperature of a gas refrigerant discharged from the compressor 2 and a pressure sensor 17 configured to detect a pressure of the gas refrigerant discharged from of the compressor 2.

The outdoor unit 12 of the air-conditioning apparatus 1 includes a controller 18 configured to perform control of the air-conditioning apparatus 1, such as drive of actuators including the compressor 2, the fans 13 and 15, the bypass valve 10, and the four-way valve 3. To the controller 18, detection signals of the indoor temperature sensor 14, the temperature sensor 16, and the pressure sensor 17 are input.

The controller 18 includes, for example, a microcomputer or a digital signal processor (DSP) and others.

The controller 18 is configured to acquire the indoor temperature from the indoor temperature sensor 14, and when the indoor temperature approaches a set temperature, perform a thermo-off operation in which the operation of the compressor 2 is stopped and only air blowing by the fan 13 is performed.

Further, the controller 18 is configured to acquire from the temperature sensor 16 the temperature of the gas refrigerant discharged from the compressor 2 and acquire from the pressure sensor 17 the pressure of the gas refrigerant discharged from the compressor 2, and based on those acquired values, control the operation of the compressor 2 and opening and closing of the bypass valve 10. To implement this control, the controller 18 stores a program corresponding to a flowchart of FIG. 2 and also stores a map of FIG. 3.

Next, an operation example at the time of the cooling operation of the air-conditioning apparatus 1 is described. When the passage of the four-way valve 3 is switched to a passage for the cooling operation by the controller 18, the refrigerant is compressed by the compressor 2 to become a high-temperature and high-pressure gas refrigerant, and the high-temperature and high-pressure gas refrigerant flows into the outdoor heat exchanger 6 via the four-way valve 3. The high-temperature and high-pressure gas refrigerant that has flowed into the outdoor heat exchanger 6 exchanges heat with outdoor air passing through the outdoor heat exchanger 6, and the heat is transferred to the outside. Then, this refrigerant becomes a high-pressure liquid refrigerant and flows out of the outdoor heat exchanger 6. The high-pressure liquid refrigerant that has flowed out of the outdoor heat exchanger 6 has its pressure reduced by the expansion valve 5 to become a low-pressure two-phase gas-liquid refrigerant, and flows into the indoor heat exchanger 4. The two-phase gas-liquid refrigerant that has flowed into the indoor heat exchanger 4 exchanges heat with the indoor air passing through the indoor heat exchanger 4, cools the indoor air to become a low-temperature and low-pressure gas refrigerant, and is then sucked into the compressor 2.

Next, an operation example at the time of the heating operation of the air-conditioning apparatus 1 is described. When the passage of the four-way valve 3 is switched to a passage for the heating operation by the controller 18, the refrigerant is compressed by the compressor 2 to become a high-temperature and high-pressure gas refrigerant in the same manner as described above, and the high-temperature and high-pressure gas refrigerant flows into the indoor heat exchanger 4 via the four-way valve 3. The high-temperature and high-pressure gas refrigerant that has flowed into the indoor heat exchanger 4 exchanges heat with the indoor air passing through the indoor heat exchanger 4, heats the indoor air, and then becomes a high-pressure liquid refrigerant. The high-pressure liquid refrigerant that has flowed out of the indoor heat exchanger 4 has its pressure reduced by the expansion valve 5 to become a low-pressure two-phase gas-liquid refrigerant, and flows into the outdoor heat exchanger 6. The low-pressure two-phase gas-liquid refrigerant that has flowed into the outdoor heat exchanger 6 exchanges heat with the outdoor air passing through the outdoor heat exchanger 6 to become a low-temperature and low-pressure gas refrigerant, and is then sucked into the compressor 2.

Figure 2:
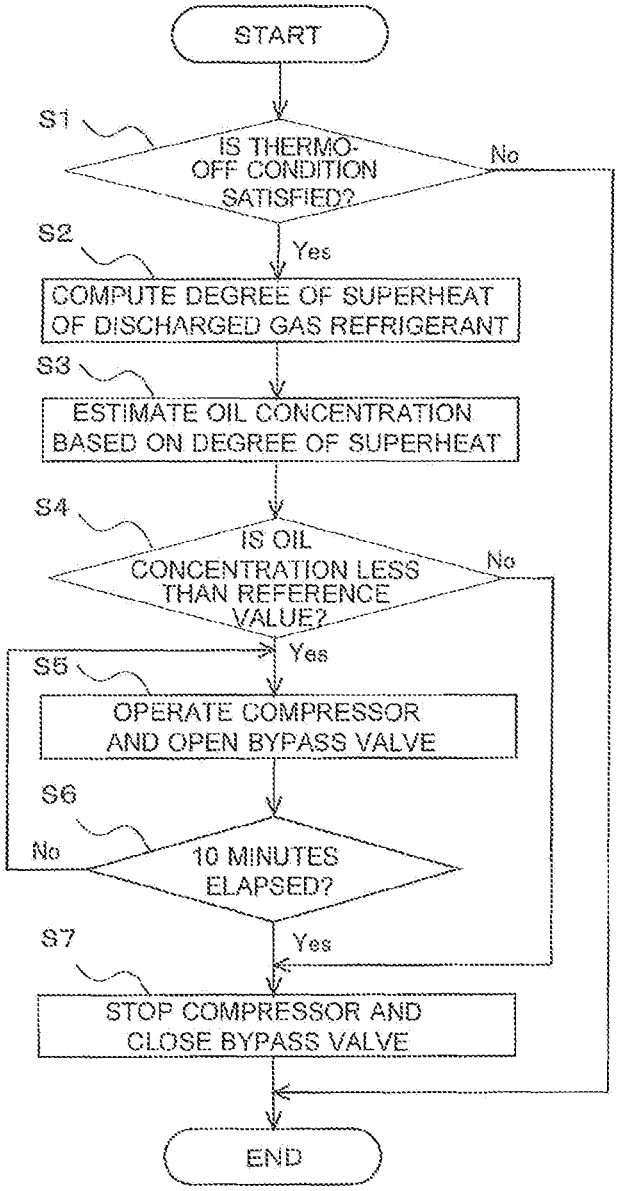
FIG. 2 is a flowchart for illustrating control of a compressor performed by the air-conditioning apparatus according to Embodiment 1 of the present invention.
Figure 3:
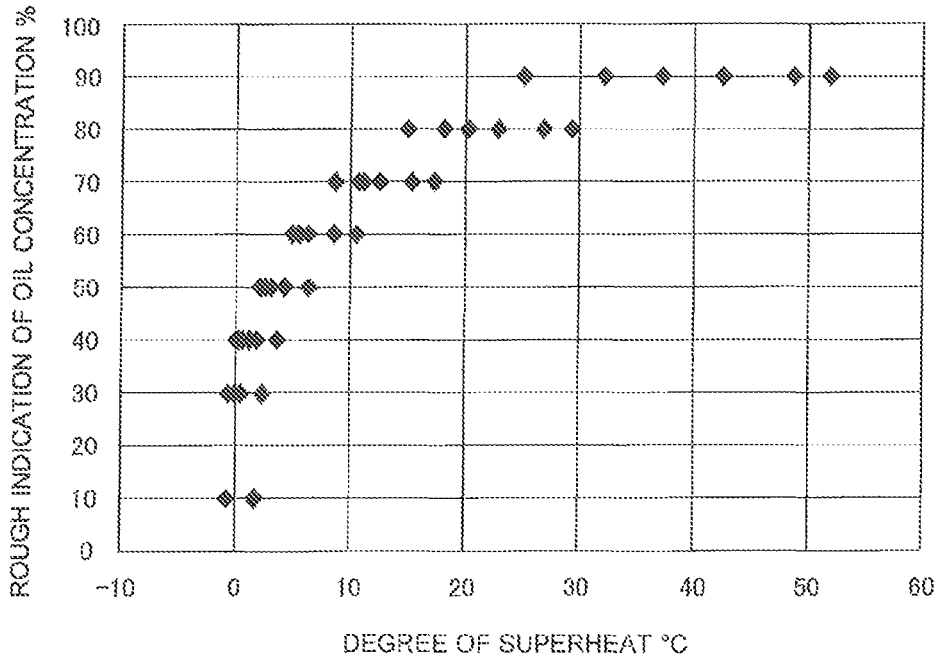
FIG. 3 is a graph showing a relation between a degree of superheat of a gas refrigerant and a concentration of refrigerating machine oil according to Embodiment 1 of the present invention.
Figure 4:
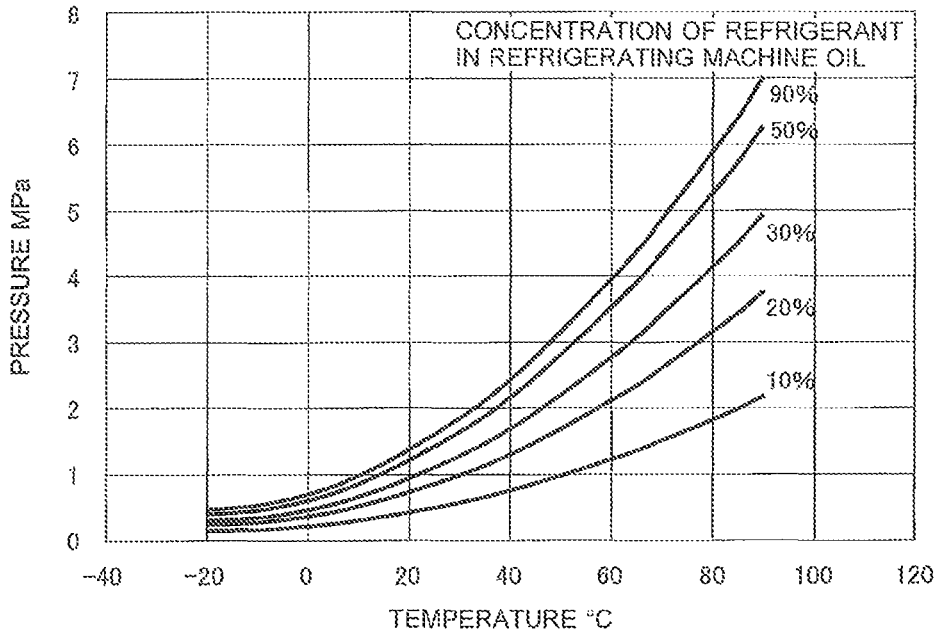
FIG. 4 is a graph showing a relation between a temperature and a pressure of ether-based refrigerating machine oil and an R410A refrigerant according to Embodiment 1 of the present invention.

FIG. 2 is a flowchart for illustrating control of the compressor performed by the air-conditioning apparatus 1 according to Embodiment 1 of the present invention. FIG. 3 is a graph showing a relation between a degree of superheat of a gas refrigerant and a concentration of the refrigerating machine oil according to Embodiment 1 of the present invention. FIG. 4 is a graph showing a relation between a temperature and a pressure of ether-based refrigerating machine oil and an R410A refrigerant according to Embodiment 1 of the present invention.

Referring to FIG. 2 to FIG. 4, the control of the compressor performed by the air-conditioning apparatus 1 is described.

In Step S1, the controller 18 determines whether or not a thermo-off condition (a condition under which the thermo-off operation is performed) is satisfied.

The thermo-off condition is satisfied when the indoor temperature acquired from the indoor temperature sensor 14 approaches the set temperature. When the thermo-off operation is performed, under a normal state, the operation of the compressor 2 is stopped and only the air blowing by the fan 13 is performed. However, in Embodiment 1, the following control is performed.

When it is determined in Step S1 that the thermo-off condition is satisfied, the controller 18 proceeds to Step S2. When it is determined in Step S1 that the thermo-off condition is not satisfied, the controller 18 ends this routine.

In Step S2, the controller 18 computes the degree of superheat of the discharged gas refrigerant.

The degree of superheat of the discharged gas refrigerant is computed in the following manner. First, the controller 18 acquires the pressure of the discharged gas refrigerant from the pressure sensor 17, and a saturated pressure that is the acquired pressure is converted into a temperature based on a pressure-temperature table. Next, the controller 18 acquires the temperature of the discharged gas refrigerant from the temperature sensor 16 and computes a degree of superheat, which is a difference between the acquired temperature and the converted temperature.

In Step S3, the controller 18 estimates an oil concentration inside the compressor 2 based on the degree of superheat computed in Step S2.

There is a correlation shown in FIG. 3 between the degree of superheat of the discharged gas refrigerant and the oil concentration, and as the degree of superheat increases, the refrigerant dissolving in the refrigerating machine oil evaporates more and the oil concentration inside the compressor 2 increases.

In this case, in FIG. 3, an example of a correlation between the degree of superheat of the R410A refrigerant and the concentration of the ether-based refrigerating machine oil is shown. The correlation shown in FIG. 3 is created based on physical property data shown in FIG. 4.

In Step S4, the controller 18 determines whether or not the oil concentration inside the compressor 2 estimated in Step S3 is less than an oil concentration reference value.

Specifically, the controller 18 determines whether or not the oil concentration is less than about 70% shown in FIG. 3, which is required to suitably lubricate the drive portion of the compressor 2.

When it is determined in Step S4 that the oil concentration is less than the oil concentration reference value, the controller 18 proceeds to Step S5. When it is determined in Step S4 that the oil concentration is equal to or more than the oil concentration reference value, the controller 18 proceeds to Step S7.

In Step S5, the controller 18 continues the operation of the compressor 2. At the same time, the controller 18 opens the bypass valve 10.

When an ambient temperature on a room side and the set temperature of the air-conditioning apparatus 1 are close to each other, it is highly likely that the thermo-off operation and a thermo-on operation in which the compressor is turned on are repeated. In such a situation, the air-conditioning apparatus 1 operates intermittently under a state in which the oil concentration inside the compressor 2 cannot be maintained at a sufficient level. Then, when this state continues for a long period of time, there is a fear that the drive portion of the compressor 2 may be deteriorated or damaged. The controller 18 continues the operation of the compressor 2 through the processing of Step S5, to thereby heat the compressor 2 and increase the oil concentration. As a result, the lubricity of the drive portion of the compressor 2 can be increased.

Further, when the thermo-off condition is satisfied, the operation of the compressor 2 is continued, and at the same time, the bypass valve 10 of the refrigerant circuit 8 is opened to limit an operation capacity of the refrigerant circuit 8. In this manner, an air-conditioning capacity is lowered to prevent the room from being cooled or heated too much.

After the processing of Step S5, the controller 18 proceeds to Step S6.

In Step S6, the controller 18 determines whether or not 10 minutes have elapsed since the operation of the compressor 2 started to be continued.

When the thermo-off operation is delayed to continue the operation of the compressor 2, there is a fear that the room may be cooled or heated too much and comfort may be deteriorated. For this reason, an upper limit of a fixed period of time, such as 10 minutes, is set to a period of time for which the operation of the compressor 2 is to be continued.

When it is determined in Step S6 that 10 minutes have elapsed, the controller 18 proceeds to Step S7. When it is determined in Step S6 that 10 minutes have not elapsed yet, the controller 18 returns to Step S5.

In Step S7, the controller 18 stops the operation of the compressor 2. At the same time, the controller 18 closes the bypass valve 10.

After the processing of Step S7, the controller 18 ends this routine.

Embodiment 2

Figure 5:
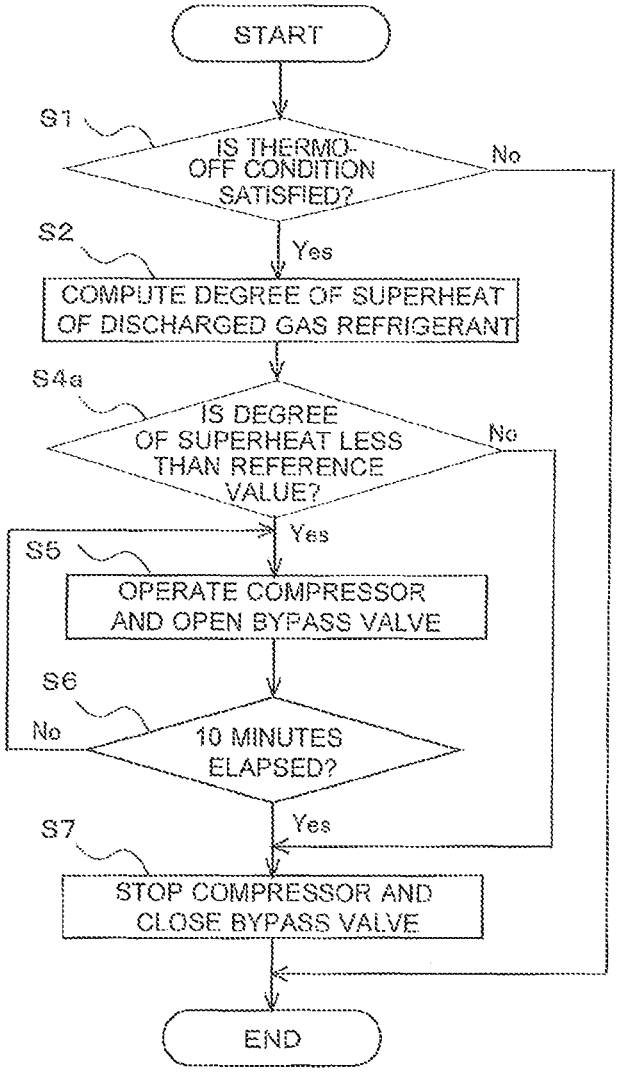
FIG. 5 is a flowchart for illustrating control of a compressor performed by an air-conditioning apparatus according to Embodiment 2 of the present invention.

FIG. 5 is a flowchart for illustrating control of the compressor performed by the air-conditioning apparatus 1 according to Embodiment 2 of the present invention.

Note that, in Embodiment 2, the overlapping description already given in Embodiment 1 is omitted.

From the correlation shown in FIG. 3, it can be considered that when the degree of superheat is 10 degrees C. or more, the oil concentration is more than about 70%. Considering this fact, without converting the degree of superheat into the oil concentration, the controller 18 may directly use the degree of superheat of 10 degrees C. or more as an index for the determination to determine whether or not to continue the operation. With this configuration, the calculation processing performed by the controller 18 can be simplified.

After the processing of Step S2, the controller 18 proceeds to Step S4*a*.

In Step S4*a*, the controller 18 determines whether or not the degree of superheat computed in Step S2 is less than a value corresponding to an oil concentration reference value.

Specifically, the controller 18 determines whether or not the degree of superheat is less than 10 degrees C. When the degree of superheat is less than 10 degrees C., this degree of superheat corresponds to an oil concentration of about 70% shown in FIG. 3, which is required to suitably lubricate the drive portion of the compressor 2.

When it is determined in Step S4*a* that the degree of superheat is less than the degree-of-superheat reference value, the controller 18 proceeds to Step S5. When it is determined in Step S4*a* that the degree of superheat is equal to or higher than the degree-of-superheat reference value, the controller 18 proceeds to Step S7.

The following control is the same as in Embodiment 1.

In Embodiments 1 and 2 described above, the controller 18 is configured to estimate the oil concentration inside the compressor 2 based on the temperature of the gas refrigerant discharged from the compressor 2 and the pressure of the gas refrigerant discharged from the compressor 2, and when the oil concentration is less than the oil concentration reference value, continue the operation of the compressor 2 even when the thermo-off condition is satisfied. With this configuration, the compressor 2 is heated, and thus the refrigerant mixed with the refrigerating machine oil evaporates and the degree of superheat of the discharged gas refrigerant reaches a sufficient level. Accordingly, under a state in which the thermo-off condition is satisfied frequently, the operation is not turned on and off repeatedly for a long period of time while the oil concentration is at a low level, where lubricity is low. Therefore, under the state in which the thermo-off condition is satisfied, the oil concentration of the compressor 2 can be maintained at a sufficient level. As a result, the reliability of the compressor 2 can be enhanced.

When the oil concentration is less than the oil concentration reference value, even under the state in which the thermo-off condition is satisfied, the controller 18 is configured to continue the operation of the compressor 2, and open the bypass valve 10 to limit the operation capacity. With this configuration, when the operation of the compressor 2 is continued under the state in which the thermo-off condition is satisfied, the air-conditioning capacity of the air-conditioning apparatus 1 is lowered, and thus a room can be prevented from being cooled or heated too much.

The controller 18 is configured to compute the degree of superheat of the discharged gas refrigerant based on the temperature of the gas refrigerant discharged from the compressor 2 and the pressure of the gas refrigerant discharged from the compressor 2, and estimate the oil concentration based on the pre-defined correlation shown in FIG. 3 between the oil concentration and the degree of superheat of the gas refrigerant discharged from the compressor 2 and on the computed degree of superheat. With this configuration, the oil concentration inside the compressor 2 can be estimated based on the temperature of the gas refrigerant discharged from the compressor 2 and the pressure of the discharged gas refrigerant.

The controller 18 is configured to compute the degree of superheat of the discharged gas refrigerant based on the temperature of the gas refrigerant discharged from the compressor 2 and the pressure of the gas refrigerant discharged from the compressor 2, and when the computed degree of superheat is less than the degree-of-superheat reference value corresponding to the oil concentration reference value, continue the operation of the compressor 2 even under the state in which the thermo-off condition is satisfied. With this configuration, the calculation processing performed by the controller 18 can be simplified.

The controller 18 is configured to set an upper limit to a period of time for which the operation of the compressor 2 is to be continued even under the state in which the thermo-off condition is satisfied. With this configuration, when the operation of the compressor 2 is continued under the state in which the thermo-off condition is satisfied, a room can be prevented from being cooled or heated too much due to the continuation of the operation of the air-conditioning apparatus 1.

REFERENCE SIGNS LIST

1 air-conditioning apparatus 2 compressor 3 four-way valve 4 indoor heat exchanger 5 expansion valve 6 outdoor heat exchanger 7 refrigerant pipe 8 refrigerant circuit 9 bypass pipe 10 bypass valve 11 indoor unit 12 outdoor unit 13 fan 14 indoor temperature sensor 15 fan 16 temperature sensor 17 pressure sensor 18 controller

The invention claimed is:

1. An air-conditioning apparatus, comprising:

a refrigerant circuit comprising a compressor, an indoor heat exchanger, an expansion valve, and an outdoor heat exchanger that are connected by a refrigerant pipe to allow refrigerant to circulate through the refrigerant circuit; and a controller configured to control an operation state of the compressor, the controller being configured to determine whether a thermo-off condition is satisfied, and when the thermo-off condition is satisfied, estimate an oil concentration inside the compressor based on a temperature of the refrigerant discharged from the compressor and a pressure of the refrigerant discharged from the compressor, and determine whether the oil concentration is less than an oil concentration reference value, and when the oil concentration is less than the oil concentration reference value, continue an operation of the compressor, and when the oil concentration is equal to or more than the oil concentration reference value, stop the operation of the compressor and initiate the thermo-off operation.

2. The air-conditioning apparatus of claim 1, wherein the controller is configured to compute a degree of superheat of the discharged refrigerant based on the temperature of the refrigerant discharged from the compressor and the pressure of the refrigerant discharged from the compressor, and estimate the oil concentration based on a pre-defined correlation between the oil concentration and the degree of superheat of the refrigerant discharged from the compressor and on the computed degree of superheat.

3. The air-conditioning apparatus of claim 1, wherein the controller is configured to compute a degree of superheat of the discharged refrigerant based on the temperature of the refrigerant discharged from the compressor and the pressure of the refrigerant discharged from the compressor, and when the computed degree of superheat is less than a degree-of-superheat reference value corresponding to the oil concentration reference value, continue the operation of the compressor without the thermo-off operation even under the state in which the thermo-off condition is satisfied.

4. The air-conditioning apparatus of claim 1, wherein the controller is configured to set an upper limit to a period of time for which the operation of the compressor is to be continued without the thermo-off operation even under the state in which the thermo-off condition is satisfied.

5. An air-conditioning apparatus, comprising:

a refrigerant circuit comprising a compressor, an indoor heat exchanger, an expansion valve, and an outdoor heat exchanger that are connected by a refrigerant pipe to allow refrigerant to circulate through the refrigerant circuit;

a bypass pipe connecting a portion of the refrigerant pipe on a discharge side of the compressor and a portion of the refrigerant pipe on a suction side of the compressor; and a bypass valve provided to a middle of the bypass pipe;

a controller configured to control an operation state of the compressor, the controller being configured to estimate an oil concentration inside the compressor based on a temperature of the refrigerant discharged from the compressor and a pressure of the refrigerant discharged from the compressor, and when the oil concentration is less than the oil concentration reference value, continue the operation of the compressor without a thermo-off operation, and open the bypass valve to limit an operation capacity even under a state in which a thermo-off condition is satisfied, wherein the thermo-off operation is initiated after the oil concentration reaches a sufficient level and the thermo-off condition is satisfied.

* * * * *